US006664926B1

(12) United States Patent
Zinanti et al.

(10) Patent No.: US 6,664,926 B1
(45) Date of Patent: Dec. 16, 2003

(54) COMPACT PLANAR ANTENNA

(75) Inventors: Michael D. Zinanti, Wheat Ridge, CO (US); Shanna Carroll French, Morrison, CO (US); Randy C. Bancroft, Denver, CO (US); Kenneth T. Lawson, Jr., Lafayette, CO (US); Blaine R. Bateman, Louisville, CO (US)

(73) Assignee: Centurion Wireless Tech., Inc., Lincoln, NE (US)

( * ) Notice: Subject to any disclaimer, the term of this patent is extended or adjusted under 35 U.S.C. 154(b) by 0 days.

(21) Appl. No.: 10/096,407

(22) Filed: Mar. 12, 2002

(51) Int. Cl.[7] ..... H01Q 1/38

(52) U.S. Cl. ..... 343/700 MS; 343/846; 343/702

(58) Field of Search ..... 343/700 MS, 853, 343/829, 846, 854, 830, 702

(56) References Cited

U.S. PATENT DOCUMENTS

| | | | | | |
|---|---|---|---|---|---|
| 4,012,741 | A | * | 3/1977 | Johnson | 343/700 MS |
| 6,100,849 | A | * | 8/2000 | Tsubaki et al. | 343/702 |
| 6,157,344 | A | | 12/2000 | Bateman et al. | 343/700 MS |
| 6,249,254 | B1 | | 6/2001 | Bateman et al. | 343/700 MS |

* cited by examiner

*Primary Examiner*—James Clinger
(74) *Attorney, Agent, or Firm*—Holland & Hart LLP

(57) ABSTRACT

A compact planar antenna is disclosed wherein a radiating element in the shape of a right triangle is formed on a substrate. A ground plane may be positioned on one or both sides of the substrate. In one embodiment, the radiating elements are positioned on the substrate in groups of two or more in close proximity to one another. In another embodiment, the radiating elements are arranged in an array.

9 Claims, 1 Drawing Sheet

COMPACT PLANAR ANTENNA

BACKGROUND OF THE INVENTION

1. Field of the Invention

This invention relates to a compact planar antenna for wireless communication devices such as cellular telephones, PCMCIA cards, etc. More particularly, the compact planar antenna of this invention enables the antenna to be used in pairs or in linear array situations.

2. Description of the Related Art

A number of small patch or planar antennas have been previously provided which were generally useful for their limited intended purposes. In U.S. Pat. No. 6,157,344 (the '344 patent), a patent owned by the assignee of the instant invention, a small indoor/outdoor, shock tolerant, flat panel, transmit/receive antenna is described. U.S. Pat. No. 6,249,254 (the '254 patent), a patent owned by the assignee of the instant invention, describes the method of making the invention of the '344 patent. The disclosure of the '344 and '254 patents are included herein by reference thereto. In the antenna of the '344 patent, the radiating element thereof is triangular-shaped, or pseudo triangular-shaped, and which has two equal length sides that join to form an apex and having a base that is equal or unequal in length to the sides, thus placing the apex coincident with the antenna long axis. Although the antenna of the '344 patent performs very well, it has been found that the antenna thereof is too large for some applications. The need thereof exists for a compact planar antenna which is smaller than the antenna of the '344 patent but which has the proper gain, pattern, and bandwidth performance

SUMMARY OF THE INVENTION

A planar antenna is described which comprises a substrate fabricated from a commercial PCB laminate or other materials, and an antenna element formed on one side thereof which is formed in the shape of a right triangle or related shape. In some embodiments, a ground plane is provided on one or both sides of the substrate. In some embodiments, a pair of the antenna elements may be used. In other embodiments, a plurality of the antenna elements may be arranged in an array to increase the performance of the antenna.

It is therefore a principal object of the invention to provide a compact planar antenna which is small enough to be used in most applications.

Yet another object of the invention is to provide a compact planar antenna which is small enough to be used in most applications without sacrificing gain, pattern and bandwidth performance.

A further object of the invention is to provide a compact planar antenna which includes an antenna element in the form of a right triangle or related shape.

Yet another object of the invention is to provide a compact planar antenna which may be used in groups of two or more antennas in close proximity to one another.

Still another object of the invention is to provide a compact planar antenna including antenna elements which may be used in an array arrangement.

Yet another object of the invention is to provide a compact planar antenna which is less expensive to manufacture than certain other planar antennas.

These and other objects will be apparent to those skilled in the art.

DETAILED DESCRIPTION OF THE EMBODIMENTS

Figure 1:
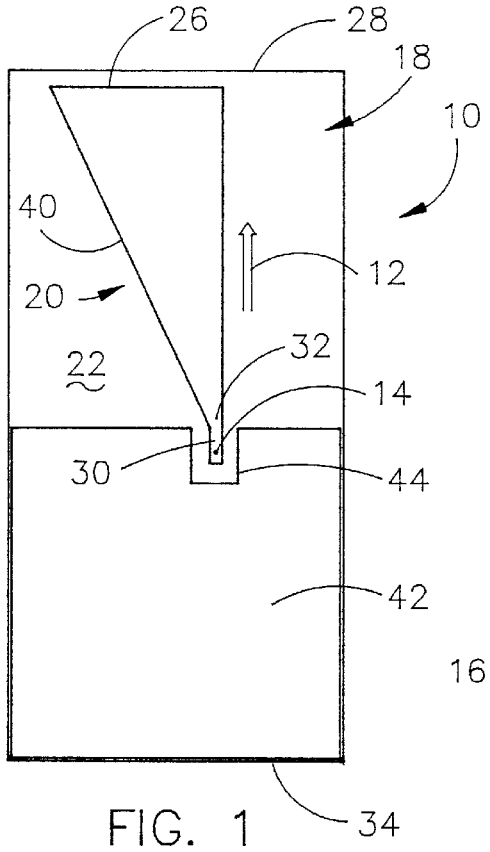
FIG. 1 is a plan view of the planar antenna of this invention positioned on a substrate which also has a ground plane mounted on the same side of the substrate.
Figure 2:
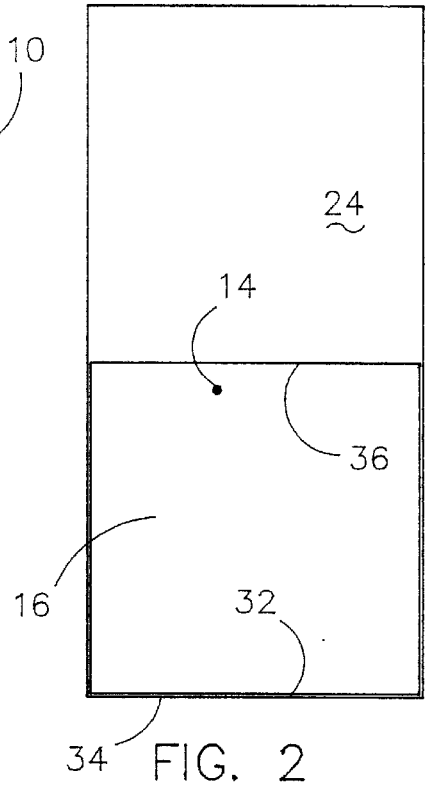
FIG. 2 is a plan view of the other side of the substrate of FIG. 1 which illustrates a ground plane provided thereon.

FIG. 1 is a top view, i.e., a view from the radiating element side, of an antenna 10 in accordance with this invention wherein a final protective non-conductive plastic coating has not been applied to the antenna, and wherein the centrally located long-axis of antenna 10 is shown by arrow 12. FIG. 2 is a bottom view, i.e., a view from the ground plane element side, of an antenna 10. The numeral 14 refers to a through hole which extends through the ground plane 16, substrate 18, and the antenna element 20 to facilitate the connection of a feed cable to the antenna.

Without limitation thereto, in a preferred embodiment of the invention, antenna 10 is formed from a relatively thin commercial PCB laminate substrate such as glass epoxy. The top and bottom flat surfaces 22 and 24 of substrate 18 carry a thin layer, coating, or film of a metal such as copper. Copper-clad substrate 18 is processed, for example, by using well-known masking and etching techniques, to provide (1) a first metal pattern on the FIG. 1 side of the substrate 18, this first metal pattern comprising a right-triangle-shaped metal radiating element 20 whose base 26 is positioned coincident with, or closely adjacent to, a first side edge or edge surface 28 of said substrate 18, and to provide a metal feed line 30 which extends from the apex 32 of the triangle, and to provide (2) a second metal pattern on the FIG. 2 side of the substrate 18, the second pattern comprising a metal ground plate element 16 having a first edge 32 that is positioned coincident with, or closely adjacent to, the second side edge or edge surface 34, and having a second edge 36 that dimensionally overlaps a portion of feed line 30, but does not overlap radiating element 20.

In the preferred embodiment of the invention, but without limitation thereto, substrate 18 is a rectangle, radiating element 20 is formed as a right triangle having sides 38 and 40 extending from the side 26 to the apex 32.

The manner of electrically connecting the antenna's radiating element 20 and ground plane element 16 take a number of forms within the spirit and scope of this invention. For example, if feed line 30 were extended to the second side 34, then one conductor of an edge connector could be connected to feed line 30, while the second conductor of the edge connector could be connected to ground plane element 16. In the embodiment shown in the drawings, the through hole 14 permits a co-axial cable to be operatively connected to the ground plane element 16 and the antenna element 20.

In an embodiment of the invention, a second ground plane element 42 may be formed on the radiating element side of the antenna 10, as seen in FIG. 1, with the ground plane element 42 having a cut-out portion 44 which leaves room for the feed line 30 without affecting the characteristics of feed line 30, as illustrated in FIG. 1. In a related embodiment, the second ground plane element may be terminated at a location intermediate between the second edge 34 and feed line 30, and in this embodiment the cut-out portion 44 is not present. In some related embodiments, the second ground plane element 42 may be connected to the first ground plane element 16 including, without limitation, by means of holes in the substrate 18 which are plated through with metal using common circuit board processing techniques.

Figure 3:
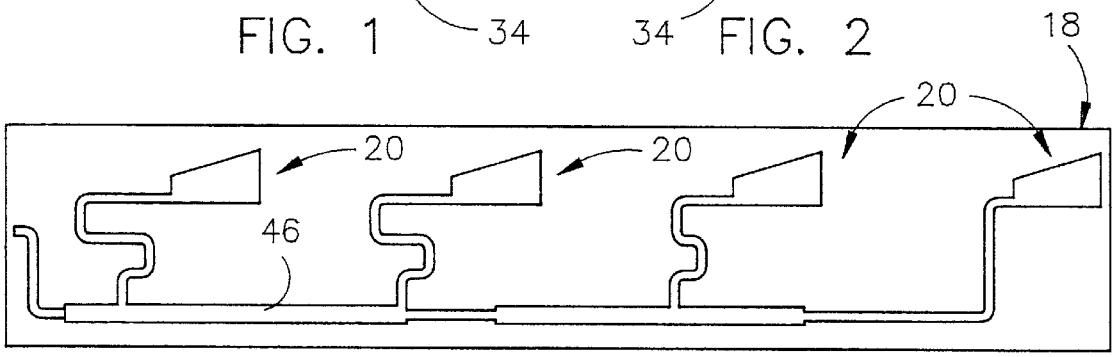
FIG. 3 is a plan view illustrating an array of the planar antenna elements provided on a substrate.

In some embodiments, the planar antenna elements 26 may be combined, as illustrated in FIG. 3, to form an array to increase the performance of the antenna. FIG. 3 illustrates an integrated feed network 46 formed on the substrate 18. The advantage of the present invention in the array embodiment of FIG. 3 over the antenna of the '344 patent is the narrower spacing that may be achieved between the feed network 46 and the antenna elements 20, owing to the more compact shape of the antenna elements 20 in the present invention when arranged such that the edge of the antenna element which is generally parallel to the long axis is nearest the feed network, as illustrated in FIG. 3.

Figure 4:
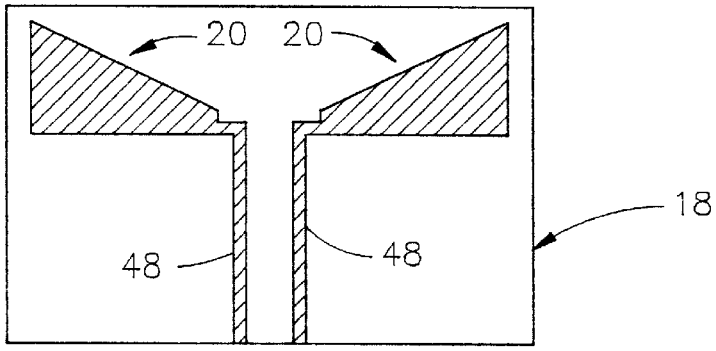
FIG. 4 is a plan view illustrating a pair of the antenna elements mounted on a substrate.

In certain applications, it may be required to use two or more antennas independent of one another in a confined space. In FIG. 4, a solution to the same is illustrated. In FIG. 4, a pair of the antenna elements 20 are utilized where the feed 48 is at an angle to the element as compared to being parallel to the long axis of the antenna element 20 shown in FIGS. 1 and 3.

In some embodiments which utilize one or more antennas operating independently in a confined spaced, the antennas may utilize a ground plane element of complex shape which may be common between the multiple elements, such as may be created by an extension of a PCMCIA card, the ground plane element being formed by an extension of the ground layers of the PCMCIA card. In these embodiments, the ground plane layer may be an intermediate layer in a multiple-layer PCB construction as is common in the manufacture of PCMCIA cards and other devices. All of these embodiments, which utilize as the antenna element the element depicted in FIGS. 1, 2, 3 and 4, are within the spirit of the present invention.

The planar antenna of this invention is ideally suited in wireless applications where small antennas are required for minimal visual impact (stealth) and in telematics applications where small planar antennas are useful to allow the device to be hidden within a vehicle. In addition, the antenna is useful in portable wireless devices including PCMCIA cards wherein the size of the card is predetermined thereby limiting the space which is available for antennas. Due to the small size of the antenna of this invention, it is useful in linear array antennas since it minimizes the resulting size of the array.

The antenna of this invention is approximately one-half the size of the Microsphere™ antenna described in U.S. Pat. No. 6,157,344 with similar gain, pattern and bandwidth performance. The antenna of this invention is ideally, suited for all the uses (applications) set forth in the '344 patent.

Thus it can be seen that the invention accomplishes at least all of its stated objectives.

We claim:

1. A compact planar antenna, comprising:

a flat dielectric substrate having a first surface, a second surface that is generally parallel to said first surface, a first edge, and a second edge which is located generally opposite said first edge;

a generally right-triangle-shaped metal radiating element on said first surface, said radiating element having an apex which is formed by the intersection of two linear triangle sides, and said radiating element having a linear triangle base at whose opposite ends said triangular sides terminate, said triangle base being located generally adjacent to said first edge;

a linear metal feed line including and formed as an extension of said apex;

a first metal ground plane embodiment on said second surface, said first ground plane element having a first edge located generally adjacent to said second edge of said substrate; and said first ground plane element having a second edge that dimensionally overlaps said feed line and only said apex of said radiating element.

2. The antenna of claim 1 wherein said triangle sides each have a length greater than said base.

3. The antenna of claim 2 wherein a second ground plane is formed on said substrate on said first surface thereof.

4. The antenna of claim 2 wherein said first surface and said second surface of said substrate is generally rectangular and wherein said one of said triangle sides is disposed parallel to the length of said substrate.

5. The antenna of claim 4 wherein said base of said radiating element is generally parallel to said first edge.

6. The antenna of claim 1 wherein radiating elements in groups of two or more are formed on said first surface of said substrate in close proximity to one another.

7. The antenna of claim 1 wherein an array of radiating elements are formed on said first surface of said substrate.

8. The antenna of claim 7 wherein said radiating elements are electrically connected to an integrated feed network formed on said substrate.

9. The antenna of claim 3 wherein said first surface and said second surface of said substrate is generally rectangular and wherein said one of said triangle sides is disposed parallel to the length of said substrate.

* * * * *